US008800895B2

(12) United States Patent
Hicks et al.

(10) Patent No.: US 8,800,895 B2
(45) Date of Patent: Aug. 12, 2014

(54) PILOTED VARIABLE AREA FUEL INJECTOR

(75) Inventors: Paul G. Hicks, Holland, MI (US); Robert J. Pederson, Thousand Oaks, CA (US)

(73) Assignee: Woodward, Inc., Fort Collins, CO (US)

( * ) Notice: Subject to any disclaimer, the term of this patent is extended or adjusted under 35 U.S.C. 154(b) by 1385 days.

(21) Appl. No.: 12/199,376

(22) Filed: Aug. 27, 2008

(65) Prior Publication Data

US 2010/0051728 A1 Mar. 4, 2010

(51) Int. Cl.
*B05B 1/00* (2006.01)
*F02M 1/00* (2006.01)
*F02M 69/00* (2006.01)

(52) U.S. Cl.
CPC .. *B05B 1/00* (2013.01); *F02M 1/00* (2013.01); *F02M 69/00* (2013.01)
USPC ..... 239/597; 239/533.2; 239/533.3; 239/533.45; 239/533.7

(58) Field of Classification Search
USPC ..... 239/88–91, 533.2–533.7, 455; 123/467, 123/299, 300, 500, 501; 137/494, 497, 504, 137/505.13, 505.14, 505.46, 505.47, 460, 137/508, 514
See application file for complete search history.

(56) References Cited

U.S. PATENT DOCUMENTS 1,876,980 A 9/1932 Lentell, Jr.
1,952,816 A 3/1934 Mock
1,969,954 A 8/1934 Taylor
2,320,964 A 6/1943 Yates
2,410,946 A 11/1946 Johnson
2,710,600 A 6/1955 Nallinger
2,801,881 A 8/1957 Campbell
2,860,780 A 11/1958 Ziesche et al.
2,921,746 A 1/1960 Burman
2,974,881 A 3/1961 Garday
2,981,483 A 4/1961 Pichon
3,116,019 A 12/1963 Graef
3,116,752 A 1/1964 Duncan
3,348,520 A 10/1967 Lockwood
3,391,910 A 7/1968 Prahl (Continued)

FOREIGN PATENT DOCUMENTS

DE 2941536 A1 4/1981
DE 41 27 455 A1 2/1993

(Continued)

OTHER PUBLICATIONS

Flow Curves of EPCO Production Nozzles; Brochure; Known prior to Dec. 1, 2010; 4 pages; EPCO The Engineered Products Company, Flint, MI.

(Continued)

*Primary Examiner* — Len Tran
*Assistant Examiner* — Joel Zhou
(74) *Attorney, Agent, or Firm* — Reinhart Boerner Van Deuren P.C.

(57) ABSTRACT

An improved fuel injection apparatus and method have a variable area injector arrangement in which a pintle defines a pilot orifice extending through a tip of the pintle for supplying a pilot flow of fuel through the fuel injector at low fuel pressures, and in particular when the pintle tip is sealed against a variable flow orifice of the variable area injector arrangement.

13 Claims, 4 Drawing Sheets

(56) References Cited

U.S. PATENT DOCUMENTS

| | | | | |
|---|---|---|---|---|
| 3,398,936 | A | 8/1968 | Delano | |
| 3,444,886 | A | 5/1969 | Bailey et al. | |
| 3,662,959 | A | 5/1972 | Sample, Jr. | |
| 3,738,976 | A | 6/1973 | Heavin | |
| 3,907,209 | A | 9/1975 | Fiedler | |
| 3,982,694 | A | 9/1976 | Bailey | |
| 4,082,067 | A | 4/1978 | Yanagihara | |
| 4,365,746 | A | 12/1982 | Tanasawa et al. | |
| 4,394,970 | A | 7/1983 | Hofmann et al. | |
| 4,549,696 | A | 10/1985 | Gaskell | |
| 4,629,127 | A | 12/1986 | Kawamura et al. | |
| 4,721,253 | A | 1/1988 | Noguchi et al. | |
| 4,865,002 | A | 9/1989 | Borst et al. | |
| 4,901,987 | A | 2/1990 | Greenhill et al. | |
| 4,958,771 | A * | 9/1990 | Klomp | 239/453 |
| 4,974,565 | A | 12/1990 | Hashimoto et al. | |
| 4,991,780 | A | 2/1991 | Kannan et al. | |
| 5,012,981 | A | 5/1991 | Holzgrefe et al. | |
| 5,058,549 | A | 10/1991 | Hashimoto et al. | |
| 5,058,808 | A | 10/1991 | Young | |
| 5,072,885 | A | 12/1991 | Hans et al. | |
| 5,522,550 | A * | 6/1996 | Potz et al. | 239/533.9 |
| 5,587,076 | A | 12/1996 | Herzog | |
| 5,713,327 | A | 2/1998 | Tilton et al. | |
| 5,735,468 | A * | 4/1998 | Casey | 239/425 |
| 5,930,999 | A | 8/1999 | Howell et al. | |
| 6,042,028 | A * | 3/2000 | Xu | 239/585.1 |
| 6,047,905 | A | 4/2000 | Honda et al. | |
| 6,089,468 | A | 7/2000 | Bouti | |
| 6,109,540 | A | 8/2000 | Coldren et al. | |
| 6,302,080 | B1 | 10/2001 | Kato et al. | |
| 6,349,886 | B1 | 2/2002 | Bouti | |
| 6,405,935 | B2 | 6/2002 | Dantes et al. | |
| 6,510,836 | B2 | 1/2003 | Ismailov | |
| 6,644,269 | B2 | 11/2003 | Kato et al. | |
| 6,823,833 | B2 | 11/2004 | Ismailov | |
| 6,920,749 | B2 | 7/2005 | Mansour et al. | |
| 7,216,632 | B2 * | 5/2007 | Nagatomo et al. | 123/467 |
| 7,370,817 | B2 | 5/2008 | Tilton et al. | |
| 7,464,885 | B1 | 12/2008 | Chang | |
| 7,546,961 | B2 * | 6/2009 | Cristiani et al. | 239/585.4 |
| 7,827,795 | B2 | 11/2010 | Hicks et al. | |
| 7,832,377 | B2 | 11/2010 | Lee et al. | |
| 2003/0201344 | A1 | 10/2003 | Wark | |
| 2006/0157018 | A1 | 7/2006 | Nakayama et al. | |
| 2007/0001033 | A1 | 1/2007 | Pasquali et al. | |
| 2007/0119966 | A1 | 5/2007 | Dry et al. | |
| 2008/0296415 | A1 * | 12/2008 | Biagetti | 239/584 |
| 2008/0308064 | A1 | 12/2008 | Yudanov | |
| 2009/0126687 | A1 | 5/2009 | Paterson | |
| 2010/0051728 | A1 | 3/2010 | Hicks | |
| 2010/0071667 | A1 | 3/2010 | Hicks et al. | |
| 2011/0108639 | A1 | 5/2011 | Hicks | |
| 2012/0138710 | A1 | 6/2012 | Hicks et al. | |

FOREIGN PATENT DOCUMENTS

| | | | |
|---|---|---|---|
| EP | 1375904 | A1 | 1/2004 |
| JP | 63-110670 | | 7/1988 |
| JP | 04-140468 | | 5/1992 |
| JP | 06-185431 | | 7/1994 |
| JP | 7015266 | B2 | 2/1995 |
| JP | 7062522 | B2 | 7/1995 |
| JP | 8049513 | A | 2/1996 |
| JP | 10-299613 | | 11/1998 |

OTHER PUBLICATIONS

Sweethaven Publishing Services; Fundamentals of Aircraft Gas Turbine Engines; 4 pages printed from website; date last visited Jul. 24, 2008; http//64.78.42.182/sweethaven/Aviation/AvEngines01lessonMain.asp?iNum=0307.

Joe Escobar; PT6 Fuel Nozzles; Aircraft Maintenance Technology; Jul. 8, 2008; 7 pages printed from website; http://www.amtonline.com.

* cited by examiner

PILOTED VARIABLE AREA FUEL INJECTOR

FIELD OF THE INVENTION

The present invention relates to spray nozzles, and more particularly to spray nozzles useful for introducing fluids into mechanisms including engines, and particularly into gas turbine combustion engines, RAM-jets, SCRAM-jets, hydrocarbon dosers and particulate filters.

BACKGROUND OF THE INVENTION

There are many devices which utilize the injection of a spray of fuel or other liquid during operation. Such devices include, but are not limited to: gas turbine engines, RAM-jets, SCRAM-jets, hydrocarbon dosers and particulate filters.

Gas turbine engines, for example, typically include a compressor section for compressing inlet air, a combustion section for combining the compressed air with fuel and combusting the fuel, and a turbine section where the energy from the hot gas produced by combustion of the fuel is converted into work. The exhaust gas from the turbine section may also be used to achieve thrust or as a source of heat and energy.

Typically, some form of fuel injectors are utilized in the combustion section for spraying a flow of fuel droplets or atomized fuel into the compressed air to facilitate combustion. In some applications, and particularly in gas turbine engines which must run at variable speeds, variable area fuel injectors have been utilized to provide a convenient and inexpensive method to inject fuel into the combustor while also metering the fuel flow to thereby eliminate the need for an additional fuel metering valve.

RAM-jets and SCRAM-jets are similar to gas turbine engines, in that they include a combustor having fuel supplied by a fuel injector, but differ from gas turbine engines in that RAM-jets and SCRAM-jets do not include a turbine section. Hydrocarbon dosers and particulate filters, of the type used to meet emission requirements for diesel engines, for example, sometimes include a combustion chamber, catalytic converter or heat exchange apparatus into or against which a spray of fuel is directed from a fuel injector. In all of these applications, variable flow fuel injectors are sometimes advantageous.

In one previous approach to providing such variable area fuel injectors, a conical-shaped surface at the end of a pintle is spring-biased into a seated position with a corresponding variable flow orifice of an injector housing. The injector housing is mounted in a fuel supply manifold. When pressurized fuel is supplied to the injector housing from the manifold, the fuel pressure overcomes the spring bias and forces the conical-shaped surface of the pintle away from the variable flow orifice in the injector housing, to thereby create a variable area opening between the conical-shaped surface of the pintle and the variable flow orifice. As the pressurized fuel passes through the opening between the conical-shaped surface and the variable flow orifice, the fuel is atomized and directed into a fan-shaped spray. The fuel flow rate, in such a fuel injector, is thus controlled by the combination of factors including the spring characteristics, fuel pressure inside the injector, and the area that is increasingly exposed as the fuel pressure is increased.

Although such variable area fuel injectors work well in many applications, they do suffer from several known drawbacks. For example, due to inherent variations involved with manufacturing and assembling the components of the variable area fuel injector, when operation is required with fuel pressures at or just above the cracking pressure of the nozzle, the flow rates through such valves can be inconsistent. Also, fuel distribution can be poor, due to uneven lifting of the conical-shaped surface of the pintle away from the variable flow orifice. As a result of these and other problems, it is known that the previous approach to proving variable area fuel injectors described above results in injectors which perform well at high fluid flow rates, but at other fuel flow rates which may occur at engine idle, or during cruise operation by an aircraft, for example, where the flow rate can be inconsistent and poor atomization may be experienced.

It is desired, therefore, to provide an improved variable area fuel injector and method of operation of a variable area fuel injector which overcomes one or more of the limitations and problems addressed above. In particular, it is desirable to provide a variable area fuel injector that is capable of delivering consistent and well-atomized flow over a wider range of operating conditions than can be achieved with prior variable area fuel injectors.

BRIEF SUMMARY OF THE INVENTION

The invention provides an improved fuel injection apparatus and method having a variable area injector arrangement in which a pintle defines a pilot orifice extending through a tip of the pintle for supplying a pilot flow of fuel through the fuel injector at low fuel pressures, and in particular when the pintle tip is sealed against a variable flow orifice of the variable area injector arrangement.

In one form of the invention, a fuel injector apparatus includes a variable area fuel injector arrangement having a pintle and spring disposed within an injector housing in such a manner that the spring urges the tip of the pintle to seal against a variable flow orifice of the housing, and such that application of pressurized fuel within the injector housing causes the pintle to move with respect to the housing such that the pintle tip is moved out of contact with the variable flow orifice of the housing as a function of the pressure of the pressurized fuel in the injector housing. In this manner, a corresponding variable area for passage of the pressurized fuel through the variable orifice is provided, about the tip of the pintle. The pintle further defines a pilot orifice extending through the tip of the pintle for supplying a pilot flow of fuel through the fuel injector apparatus when the pintle tip is seated against the variable flow orifice.

In some forms of the invention, the pilot flow of fuel continues through the pintle of the fuel injector apparatus in parallel to a main flow of fuel through the variable flow orifice of the injector arrangement, even after the tip of the pintle has been moved away from the variable flow orifice by the pressure of the pressurized fuel within the injector housing.

Some forms of the invention may include closing off the pilot fuel flow, or both the main and pilot fuel flows with a check valve disposed upstream from the pilot orifice, at fuel pressures below a cracking pressure of the check valve.

In some forms of the invention, the pilot orifice is a plain orifice. In other forms of the invention, the pilot orifice may take other forms, such as a simplex nozzle, multiple parallel plain orifices, angled multiple orifices, or any other appropriate form.

In some forms of the invention, the injector housing defines a fuel cavity disposed about the pintle upstream of the variable flow orifice, for receiving the pressurized fuel. The pintle may define a pilot orifice supply conduit extending through the pintle to provide fluid communication between the fuel cavity in the injector housing and the pilot orifice. In forms of the invention utilizing a simplex nozzle for the pilot orifice, the simplex nozzle may comprise a spin chamber disposed upstream of the pilot orifice and the supply conduit may include a portion thereof directed tangentially to the spin chamber, to facilitate atomization of the fuel.

A method for operating a fuel injector apparatus, according to the invention, may include supplying a main flow of fuel at a first flow rate through a variable area injector arrangement having a pintle, and supplying a pilot flow of fuel through the fuel injector apparatus at a second flow rate which is lower than the first fluid flow rate, through a pilot orifice extending through a tip of the pintle of the variable area injector arrangement. In one form of such a method, a main flow of fuel is supplied at a first flow rate through a variable area injector arrangement having a pintle and spring disposed within an injector housing in such a manner that the spring urges a tip of the pintle to seal against a variable flow orifice of the housing. Application of pressurized fuel within the injector housing causes the pintle to move such that the pintle tip is moved out of contact with the variable flow orifice as a function of the pressure of the pressurized fuel in the injector housing to thereby provide a corresponding variable area for passage of the pressurized fuel through the variable flow orifice about the tip of the pintle. Such a method may further include supplying a pilot flow of fuel through the fuel injector apparatus at a second flow rate lower than the first flow rate, with the pilot flow of fuel being provided through a pilot orifice extending through the tip of the pintle when the pintle tip is sealed against the variable flow orifice.

Various forms of the invention may further include supplying pressurized fluid in a parallel circuit relationship to both the variable flow orifice and the pilot orifice through a common fuel cavity disposed about the pintle in the injector housing upstream of the variable flow orifice. Some forms of the invention may include supplying pressurized fuel to the pilot orifice through a pilot orifice supply conduit extending through the pintle in a manner providing fluid communication between the fuel cavity and the injector housing and the pilot orifice.

In some forms of the invention, the pintle may include a pintle shaft, with the tip of the pintle being attached at a proximal end of the pintle shaft. The pintle shaft slidingly passes through the injector housing and terminates in a distal end of the pintle shaft disposed outside of the injector housing. The spring is operatively disposed between the injector housing and the distal end of the pintle shaft.

In some forms of the invention, the injector housing includes first and second housing sections thereof defining an injector axis and fixedly joined to one another to define a fuel cavity inside of the injector housing upstream from the variable flow orifice about the shaft of the pintle. The first housing section includes the variable flow orifice disposed substantially about the injector axis. The second housing section defines a pintle bore therein, disposed about the injector axis, for sliding passage through the pintle bore of the pintle shaft. The second housing section also defines a fluid passage therethrough providing fluid communication through the second housing section to the fluid cavity within the injector housing. The second housing section further has a distal end thereof defining a spring seat for operative receipt thereupon of a first end of the injector spring. The pintle defines a pilot orifice supply conduit extending through the pintle to provide fluid communication between the fuel cavity in the injector housing and the pilot orifice. The fuel injector apparatus may further include a second spring seat operatively connected between a second end of the injector spring and the distal end of the pintle shaft.

Other aspects, objects and advantages of the invention will be apparent from the following detailed description taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
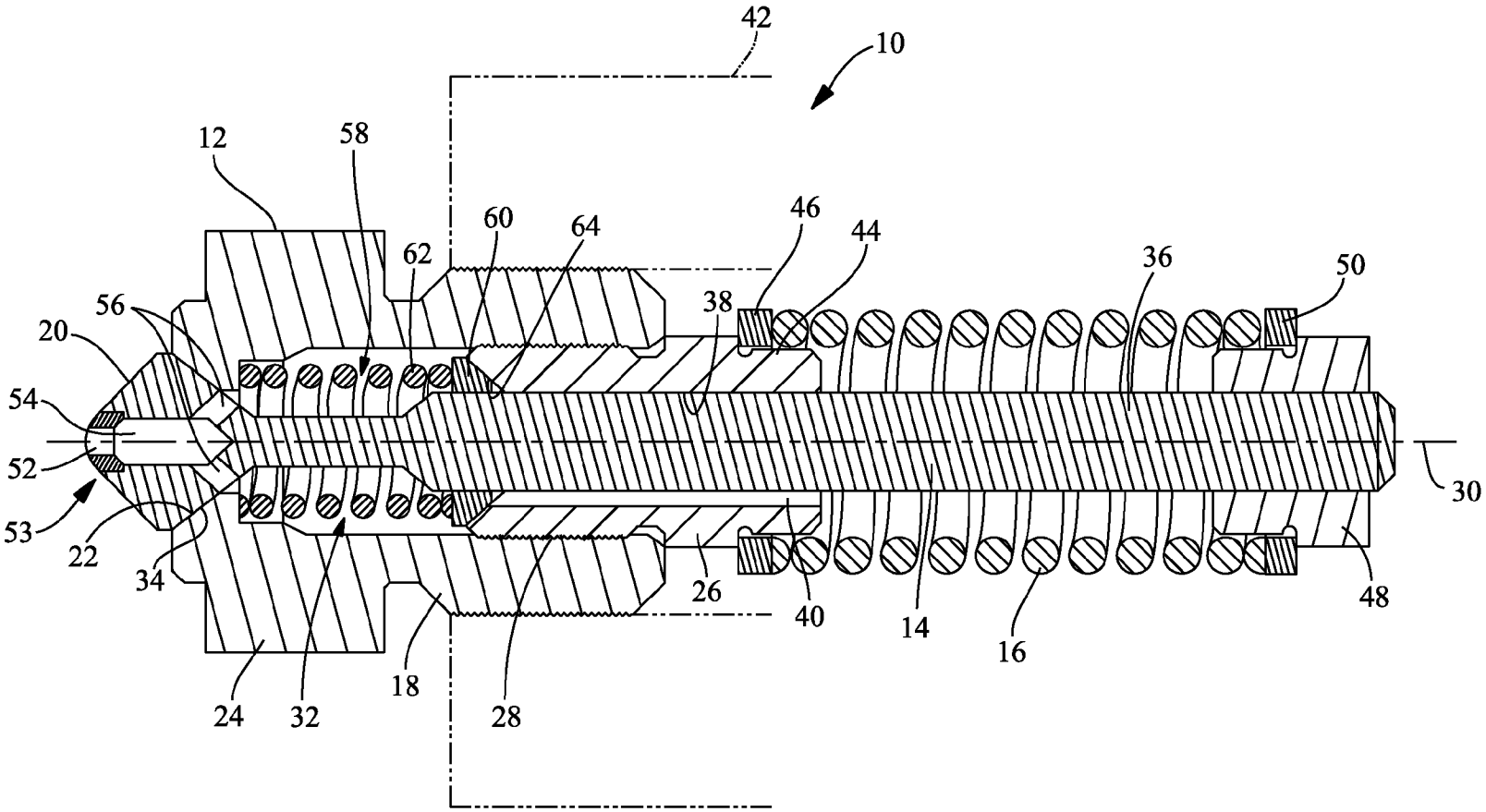
FIG. 1 is a cross-sectional illustration of a first exemplary embodiment of a fuel injector apparatus, according to the invention.

FIG. 1 shows a first exemplary embodiment of a fuel injector apparatus 10, according to the invention. The exemplary embodiment of the fuel injector apparatus 10 includes a variable area injector arrangement 12 having a pintle 14 and an injector spring 16 operatively connected to an injector housing 18. The pintle 14 and the injector spring 16 are operatively connected to the injector housing 18, in the exemplary embodiment 10, in such a manner that the spring 16 urges a tip 20 of the pintle 14 into sealing engagement with a variable flow orifice 22 of the injector housing 18.

The injector housing 18, in the exemplary embodiment 10, includes first and second housing sections 24, 26, which are fixedly attached to one another by a threaded connection, as indicated at 28. The first and second housing sections 24, 26 also define an axis 30 of the exemplary embodiment of the fuel injector apparatus 10. In other embodiments of the invention, a single-piece injector housing may be used, or a multi-part housing may be configured and joined other than by the threaded connection of the exemplary embodiment 10.

When the first and second housing sections 24, 26 are joined together, as shown in FIG. 1, they collectively define a fuel cavity 32 inside of the injector housing 18, upstream from and terminating in the variable flow orifice 22, about the axis 30 of the fuel injector 10.

By virtue of the above described configuration, it will be understood by those having skill in the art that the application of pressurized fuel within the fuel cavity of the injector housing exerts a force against the tip 20 of the pintle 14, urging the pintle to move in a direction such that the pintle tip 20 is moved out of contact with the variable flow orifice 22 of the injector housing 18. It will be further understood, that the extent of the movement of the tip 20 of the pintle 14, away from the variable flow orifice 22, is a function of a variety of factors including the pressure of the pressurized fuel in the fuel cavity, the operating characteristics of the pintle spring 16, and the respective area differential between the exposed portion of the tip 20 of the pintle 14 to the pressurized fluid. The interaction of these various features and pressures result in a change in the area of the space formed between the tip 20 of the pintle 14 and the variable flow orifice 22 which corresponds to the pressure of the pressurized fluid within the fuel cavity 32.

It will be understood that, although the exemplary embodiment 10 of the invention shown in FIG. 1 depicts the tip 20 of the pintle 14 as having a conical sealing surface 34 thereof which is configured to seal against a corresponding conical-shaped surface of the variable flow orifice 22, in other embodiments of the invention the interface between the tip 20 of the pintle 14 and the variable flow orifice 22 may take other appropriate configurations consistent with the construction and operation of an apparatus according to the invention.

The pintle 14, in the exemplary embodiment of the fuel injector 10 has a pintle shaft 36 with the tip 20 of the pintle 14 being attached to one end of the pintle shaft 36.

The variable flow orifice 22, in the exemplary embodiment of the fuel injector 10 is defined by the first housing section 24, and disposed about the axis 30. The second housing section 26 includes a pintle bore 38 therein disposed about the injector axis 30 for sliding passage therethrough of the pintle shaft 36 when the pintle shaft 36 is inserted into the housing 18 through the variable flow orifice 22. The second housing section 26 also defines a fluid passage 40, which extends along the pintle shaft 36 to provide fluid communication into the fuel cavity 32, from a fluid manifold, shown by dashed lines 42 in FIG. 1, when the fuel injector 10 is threaded into the fluid manifold 42 by threads on the first section 24 of the injector housing 18.

A distal end of the second housing section 24 is configured to define a first spring seat 44, for operative receipt thereupon of a first thrust washer 46 and a first end of the pintle spring 16. A second spring seat 48 and a second thrust washer 50 are operatively attached at the distal end of the pintle shaft 36, in such a manner that the pintle spring 16 urges the conical faces of the tip 20 of the pintle 14 and the variable flow orifice 22 into sealing contact with one another.

The tip 20 of the pintle 14, in the exemplary embodiment of the fuel injector apparatus 10, defines a pilot orifice 52 extending through the tip 20 of the pintle 14, in a manner described in greater detail below, to provide fluid communication through the fuel injector 10, and thereby also provide a path for a pilot flow of pressurized fluid from the pilot orifice 52 when the pintle tip 20 is sealed against the variable flow orifice 22. Specifically, in the embodiment 10 shown in FIG. 1, the pintle orifice 52 is provided by a simplex orifice arrangement 53 which includes a spin chamber 54 disposed upstream of the pilot orifice 52, and several supply conduits 56 which include portions thereof directed tangentially to an outer peripheral wall of the spin chamber 54, in a manner known in the art, to generate a swirling or vortex motion in the pilot flow of fuel passing through the spin chamber 54. The supply conduits 56 extend through the conical-shaped surface 34 of the tip 20 of the pintle 14 to provide fluid communication between the spin chamber 54 and the fuel cavity 32 inside the injector housing 18.

From the foregoing description, it will be understood that, in the exemplary embodiment 10, pressurized fluid from the fuel cavity 32 is supplied in a parallel circuit relationship to both the variable flow orifice 22 and the pilot orifice 52, with the fuel cavity 32 forming a common fuel cavity disposed about the pintle 14 in the injector housing 18 upstream of the variable flow orifice 22.

The first exemplary embodiment of the injector apparatus 10 also includes a check valve arrangement 58 disposed upstream from the pilot orifice 52, within the fuel cavity 32 for closing off both the pilot flow through the pilot orifice 52 and variable flow through the variable flow orifice 22 at fuel pressures below a cracking pressure of the check valve 58.

Specifically, the check valve 58 includes a check valve poppet 60, biased by a check valve spring 62 into engagement with a check valve seat 64 in the interior end of the second housing section 26, for closing off fluid communication through the fluid passage 40 with the fuel cavity 32, until the fuel pressure in the fuel manifold 42 rises to a high enough pressure to force the check valve poppet 60 away from the check valve seat 64 against the force of the check valve spring 62. It is contemplated that, in other embodiments of the invention, a check valve arrangement may be provided in a form which would block off flow through only the pilot orifice 52 below the cracking pressure of such a check valve arrangement. It is further contemplated, that in an arrangement having a check valve only blocking flow through the pilot orifice 52, that such a check valve might be disposed within the pintle 14.

Figure 2:
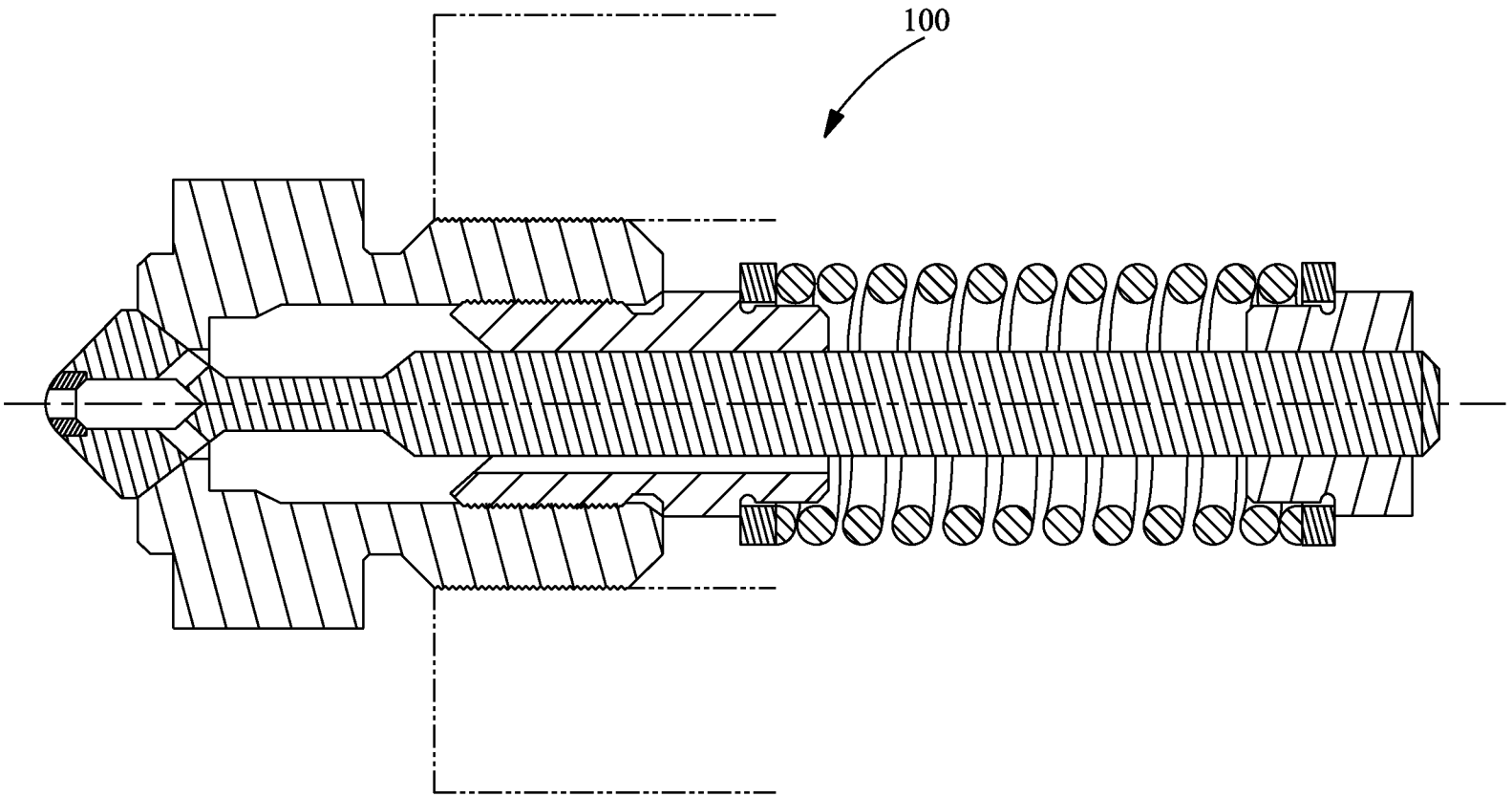
FIG. 2 is a cross-sectional illustration of a second exemplary embodiment of a fuel injector apparatus, according to the invention, which is substantially similar to the first exemplary embodiment of the invention shown in FIG. 1, except that in the second exemplary embodiment shown in FIG. 3 a check valve arrangement is not included.

FIG. 2 shows an alternate exemplary embodiment of a fuel injector apparatus 100, according to the invention, which is substantially identical to the first exemplary embodiment of the fuel injector 10 shown in FIG. 1, with the exception that the second exemplary embodiment 100 of the fuel injector does not include a check valve arrangement.

Figure 3A:
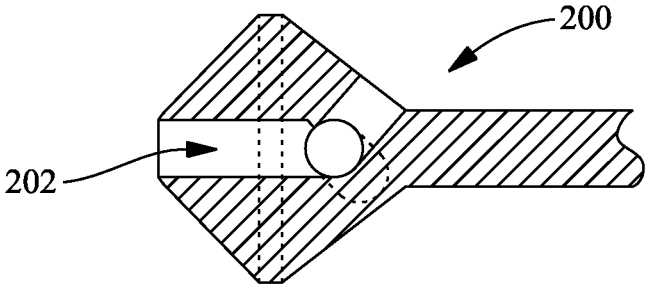
FIGS. 3A-3D are partial cross-sectional views of alternate embodiments of the tip of a pintle used in accordance with the invention.
Figure 3B:
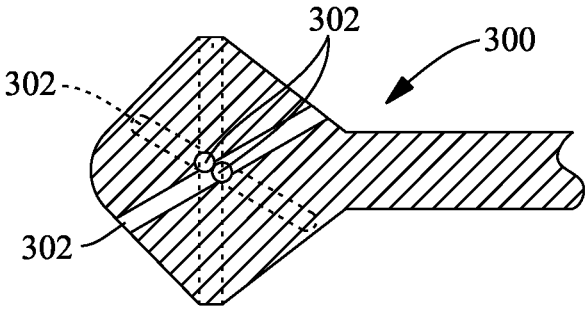
Figure 3C:
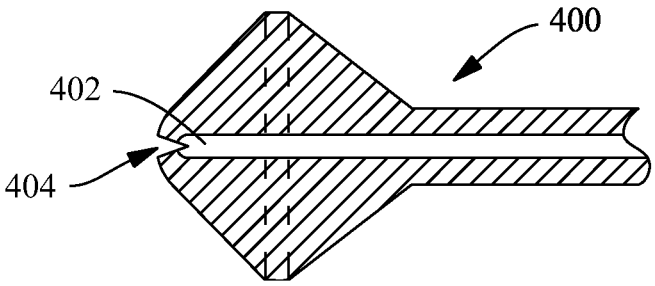
Figure 3D:
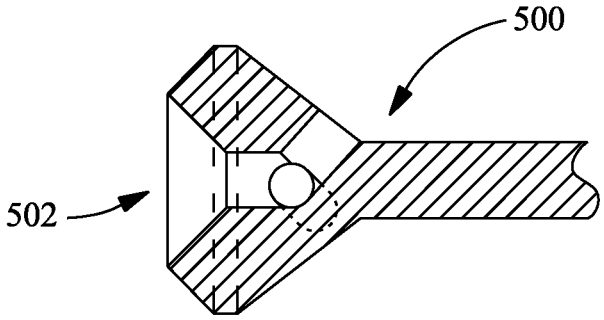

It is contemplated that, in other embodiments of the invention, the pilot orifice may take a variety of other appropriate forms for practicing the invention, some of which are illustrated in FIGS. 3A-3D. For example, as shown in FIG. 3A, a pintle 200, according to the invention, may include a single plain orifice 202 extending substantially along an axis of the injector. FIG. 3B shows a pintle 300, according to the invention, having a plurality of angled and intersecting pilot orifices 302. FIG. 3C shows a pintle 400, according to the invention, having a pilot orifice 402 of the fan-spray type, which includes a flow-directing groove 404 cut across an end of the pintle 400 to disperse fuel flowing through the pilot orifice 402. FIG. 3D shows an embodiment of a pintle 500, according to the invention, having a diverging pilot orifice 502. It will be understood, that in various embodiments of the invention, the pilot orifice may take any appropriate form in accordance with the invention.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A fuel injector apparatus, comprising:

a variable area injector arrangement having a pintle and spring operatively connected to an injector housing in such a manner that the spring urges a tip of the pintle to seal against a variable flow orifice of the housing, and such that application of pressurized fuel within the injector housing causes the pintle to move such that the pintle tip is moved out of contact with the variable flow orifice of the housing as a function of the pressure of the pressurized fuel in the injector housing, to thereby provide a corresponding variable area for passage of the pressurized fuel through the variable flow orifice about the tip of the pintle;

the pintle further defining a pilot orifice extending through the tip of the pintle for supplying a pilot flow of fuel through the fuel injector apparatus when the pintle tip is sealed against the variable flow orifice;

wherein:

the injector housing defines a fuel cavity disposed about the pintle upstream of the variable flow orifice for receiving the pressurized fuel;

the pintle defines a pilot orifice supply conduit extending through the pintle to provide fluid communication between the fuel cavity in the injector housing and the pilot orifice;

wherein, the pilot orifice is a simplex nozzle; and wherein, the simplex nozzle comprises a spin chamber disposed upstream of the pilot orifice and the supply conduit includes a portion thereof directed tangentially to the spin chamber.

2. A fuel injector apparatus, comprising;

a variable area injector arrangement having a pintle and spring operatively connected to an injector housing in such a manner that the spring urges a tip of the pintle to seal against a variable flow orifice of the housing, and such that application of pressurized fuel within the injector housing causes the pintle to move such that the pintle tip is moved out of contact with the variable flow orifice of the housing as a function of the pressure of the pressurized fuel in the injector housing, to thereby provide a corresponding variable area for passage of the pressurized fuel through the variable flow orifice about the tip of the pintle;

the pintle further defining a pilot orifice extending through the tip of the pintle for supplying a pilot flow of fuel through the fuel injector apparatus when the pintle tip is sealed against the variable flow orifice;

wherein:

the injector housing defines a fuel cavity disposed about the pintle upstream of the variable flow orifice for receiving the pressurized fuel;

the pintle defines a pilot orifice supply conduit extending through the pintle to provide fluid communication between the fuel cavity in the injector housing and the pilot orifice; and further comprising, a check valve disposed upstream from the pilot orifice and configured for precluding fuel flow through the pilot orifice until the pressurized fuel in the fuel cavity has reached a cracking pressure of the check valve.

3. The apparatus of claim 2, wherein, the check valve includes a movable valve element having a spring operatively connected to the valve element for urging the valve element into a closed position.

4. The apparatus of claim 2, wherein, the pilot orifice is a plain orifice.

5. The apparatus of claim 2, wherein, the pilot orifice is a simplex nozzle.

6. The apparatus of claim 5, wherein, the simplex nozzle comprises a spin chamber disposed upstream of the pilot orifice and the supply conduit includes a portion thereof directed tangentially to the spin chamber.

7. A method for operating a fuel injector apparatus, the method comprising:

supplying a main flow of fuel at a first flow rate through a variable area injector arrangement having a pintle and spring disposed within an injector housing in such a manner that the spring urges a tip of the pintle to seal against a variable flow orifice of the housing, and such that application of pressurized fuel within the injector housing causes the pintle to move such that the pintle tip is moved out of contact with the variable flow orifice of the housing as a function of the pressure of the pressurized fuel in the injector housing, to thereby provide a corresponding variable area for passage of the pressurized fuel through the variable flow orifice about the tip of the pintle;

supplying a pilot flow of fuel through the fuel injector apparatus at a second flow rate lower than the first flow rate through a pilot orifice extending through the tip of the pintle when the pintle tip is sealed against the variable flow orifice; and further comprising, closing off the pilot flow with a check valve disposed upstream from the pilot orifice, at fuel pressures below a cracking pressure of the check valve.

8. A fuel injector apparatus, comprising:

a variable area injector arrangement having a pintle and pintle spring operatively connected to an injector housing in such a manner that the spring urges a tip of the pintle to seal against a variable flow orifice of the housing, and such that application of pressurized fuel within the injector housing causes the pintle to move such that the pintle tip is moved out of contact with the variable flow orifice of the housing as a function of the pressure of the pressurized fuel in the injector housing, to thereby provide a corresponding variable area for passage of the pressurized fuel through the variable flow orifice about the tip of the pintle; and the pintle further defining a pilot orifice extending through the tip of the pintle providing fluid communication through the fuel injector apparatus to thereby provide a path for a pilot flow of the pressurized fluid from the pilot orifice when the pintle tip is sealed against the variable flow orifice;

the pintle having a pintle shaft with the tip of the pintle being attached at a proximal end thereof, the pintle shaft slidingly passing through the injector housing and terminating in a distal end of the pintle shaft disposed outside of the injector housing;

the spring being operatively disposed between the injector housing and the distal end of the pintle shaft;

wherein:

the injector housing further comprises first and second housing sections thereof defining an injector axis and fixedly joined to one another to define a fuel cavity inside the housing upstream from the variable flow orifice about the shaft of the pintle;

the first housing section including the variable flow orifice disposed substantially about the injector axis;

the second housing section defining a pintle bore therein disposed about the injector axis for sliding passage therethrough of the pintle shaft;

the second housing section also defining a fluid passage therethrough providing fluid communication through the second housing section to the fluid cavity within the injector housing;

the second housing section further having a distal end thereof defining a spring seat for operative receipt thereupon of a first end of the injector spring;

the pintle defines a pilot orifice supply conduit extending through the pintle to provide fluid communication between the fuel cavity in the injector housing and the pilot orifice; and the apparatus further comprises a second spring seat operatively connected between a second end of the spring and the distal end of the pintle shaft.

9. The apparatus of claim 8, wherein, the pilot orifice is a plain orifice.

10. The apparatus of claim 8, wherein, the pilot orifice is a simplex nozzle.

11. The apparatus of claim 10, wherein, the simplex nozzle comprises a spin chamber disposed upstream of the pilot orifice and the supply conduit includes a portion thereof directed tangentially to the spin chamber.

12. A fuel injector apparatus, comprising:

a variable area injector arrangement having a pintle and spring operatively connected to an injector housing in such a manner that the spring urges a tip of the pintle to seal against a variable flow orifice of the housing, and such that application of pressurized fuel within the injector housing causes the pintle to move such that the pintle tip is moved out of contact with the variable flow orifice of the housing as a function of the pressure of the pressurized fuel in the injector housing, to thereby provide a corresponding variable area for passage of the pressurized fuel through the variable flow orifice about the tip of the pintle;

a simplex nozzle for supplying a pilot flow of fuel through the fuel injector apparatus when the pintle tip is sealed against the variable flow orifice; and wherein the simplex nozzle comprises a simplex orifice having a spin chamber disposed upstream of the simplex orifice, and a plurality of supply conduits which include portions thereof directed tangentially to an outer peripheral wall of the spin chamber to generate a swirling or vortex motion in the pilot flow of fuel passing through the spin chamber.

13. The fuel injector apparatus of claim 12, wherein the simplex nozzle is formed at least in part by the pintle such that the simplex orifice extends through the tip of the pintle.

* * * * *